US005592032A

United States Patent [19]

Keizer et al.

[11] Patent Number: 5,592,032

[45] Date of Patent: Jan. 7, 1997

[54] SECURITY POWER INTERRUPT

[75] Inventors: Daniel J. Keizer, 38 First Avenue, Schumacher, Ontario, Canada, P0N 1G0; Steven A. Lax, 193 Crestwood Road, Toronto, Ontario, Canada, L4J 1A8; Robert K. Muylwyk, Toronto, Canada

[73] Assignees: Daniel J. Keizer, Schumacher; Steven A. Lax, Toronto, both of Canada

[21] Appl. No.: 559,457

[22] Filed: Nov. 15, 1995

Related U.S. Application Data

[63] Continuation-in-part of Ser. No. 173,046, Dec. 27, 1993, Pat. No. 5,486,725.

[51] Int. Cl.[6] ..... H01H 71/24

[52] U.S. Cl. ..... 307/116; 307/40; 307/42; 307/112; 307/131; 307/139; 307/140; 307/142; 335/172; 200/51.02; 340/500; 340/540

[58] Field of Search ..... 307/116, 112, 307/40, 42, 131, 139, 140, 142; 335/172; 361/72, 71; 340/500, 540; 200/50 R, 51.2, 61.64

[56] References Cited

U.S. PATENT DOCUMENTS

| | | | |
|---|---|---|---|
| 1,146,016 | 7/1915 | Burns . | |
| 3,143,067 | 8/1964 | Rorke | 200/43 |
| 4,247,743 | 1/1981 | Hinton et al. | 200/44 |
| 4,277,659 | 7/1981 | DeRemer | 200/61.62 |
| 4,303,867 | 12/1981 | Van Der Meulen | 315/360 |
| 4,323,762 | 4/1982 | Ervin et al. | 219/482 |
| 4,348,696 | 9/1982 | Beier | 358/188 |
| 4,463,228 | 7/1984 | Osika | 200/51 |
| 4,659,909 | 4/1987 | Knutson | 219/452 |
| 4,736,195 | 4/1988 | McMurtry et al. | 340/568 |
| 4,782,420 | 11/1988 | Holdgaard-Jensen | 361/58 |
| 4,870,531 | 9/1989 | Danek | 361/93 |
| 5,071,360 | 12/1991 | Lindow et al. | 439/133 |
| 5,434,558 | 7/1995 | Zeder | 340/568 |
| 5,488,208 | 1/1996 | Seewald | 200/43.22 |

FOREIGN PATENT DOCUMENTS

| | | | |
|---|---|---|---|
| 84301352 | 10/1984 | European Pat. Off. | G07C 9/00 |
| 85201738 | 4/1987 | European Pat. Off. | G07F 15/00 |
| 88116873 | 4/1990 | European Pat. Off. | A61B 6/00 |
| 4229731A1 | 4/1993 | Germany | H02B 15/00 |
| WO85/03789 | 8/1985 | WIPO | G07C 9/00 |
| WO89/02968 | 4/1989 | WIPO | E05B 49/00 |
| WO93/14350 | 7/1993 | WIPO | F24C 3/12 |
| 94/00706 | 12/1994 | WIPO . | |

*Primary Examiner*—William M. Shoop, Jr.
*Assistant Examiner*—Albert W. Paladini
*Attorney, Agent, or Firm*—Mark B. Eisen

[57] ABSTRACT

A security electrical interrupt device for preventing unauthorized usage of an electrical appliance such as an electric stove, while retaining operation of auxiliary electrical equipment such as the lights and an electrical clock. The device comprises a relay controlled by a micro-processor based programmable controller which measures the amount of electrical supply current being drawn by the appliance. A software computer program stored in the microcontroller commands the relay to disconnect the supply power if any person attempts to operate any part of the appliance which draws electrical current exceeding a preset limit while the controller is in the interrupt mode. In a preferred embodiment the microcontroller is programmed to enter the interrupt mode by 1) key sequences entered on a detachable key pad, 2) when a selected amount of time has elapsed since the last authorized usage, or 3) by removal of the detachable key pad. The microcontroller restores full supply power to the appliance by key sequences entered on the key pad.

9 Claims, 3 Drawing Sheets

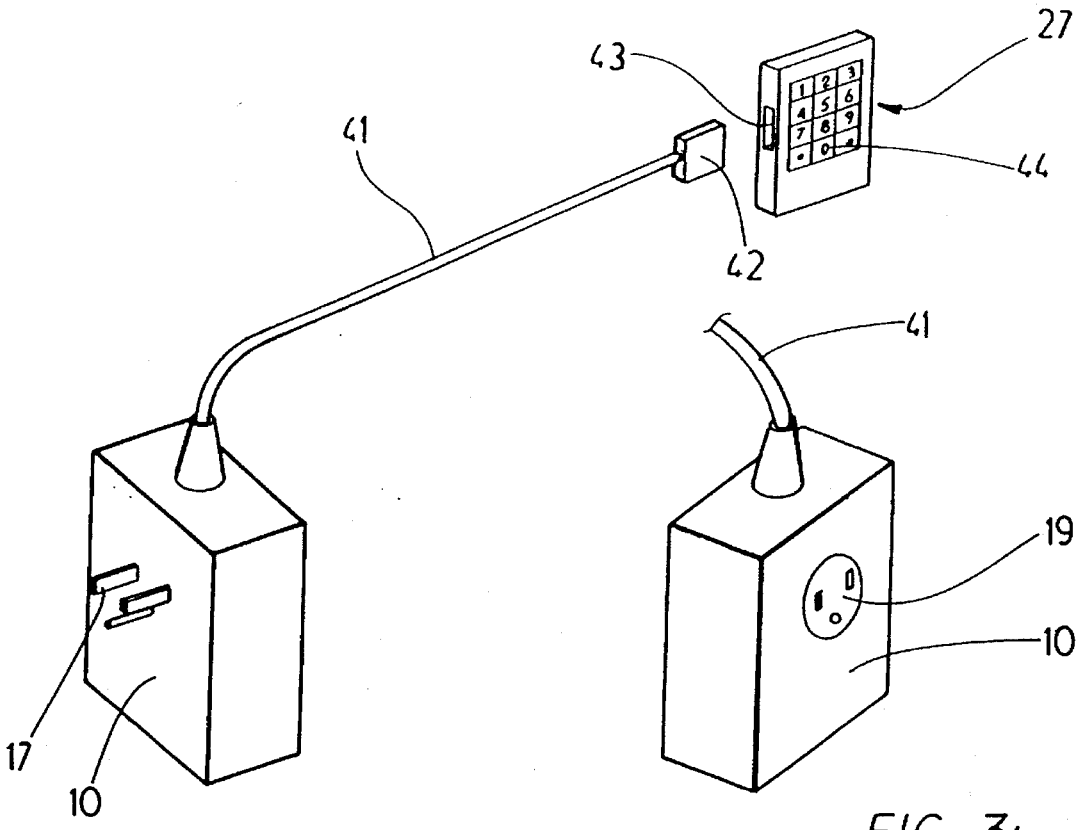
FIG. 3b
FIG. 3a
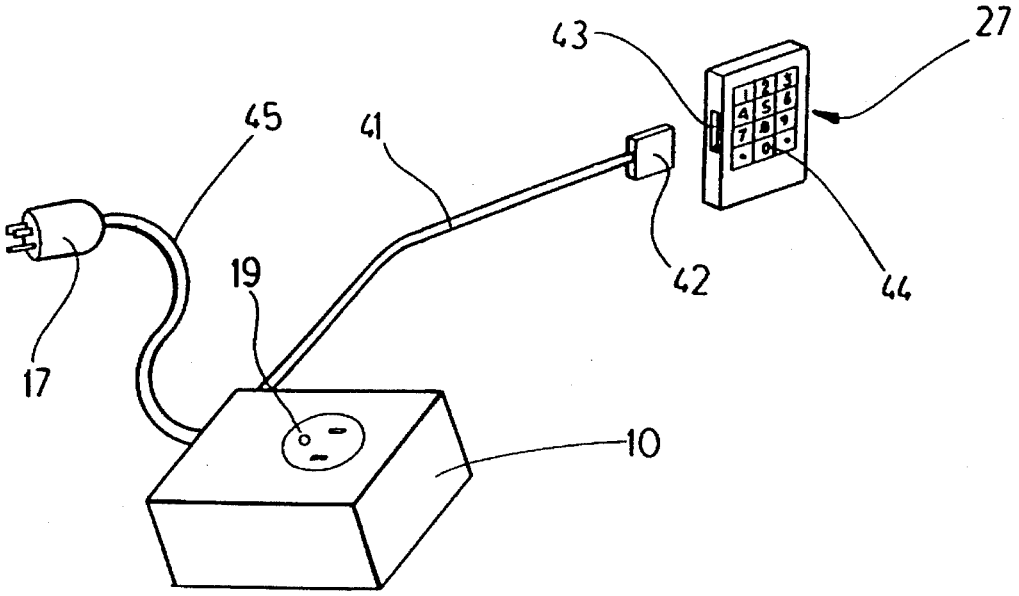
FIG. 4

SECURITY POWER INTERRUPT

This application is a continuation-in-part of U.S. patent application Ser. No. 08/173,046 filed Dec. 27, 1993, now U.S. Pat. No. 5,486,725.

FIELD OF THE INVENTION

The present invention relates to an electrical security power interrupt device, and more particularly to a device that prevents and/or controls the unauthorized use of an electrical appliance by enabling an authorized user to select a mode which will interrupt the supply power to the appliance if a high current-drawing component is activated,

BACKGROUND OF THE INVENTION

Many household electrical appliance can be hazardous if not properly used and monitored. There are many recorded instances of disastrous home fires caused by unauthorized operation of a household appliance such as a stove by children, burglars or vandals, or persons of reduced capacity or faculties such as the elderly. It is thus advantageous to be able to selectively control the use of such appliances.

In the prior art, means have been provided to prevent unauthorized usage of electrical appliances, primarily through key operated electro-mechanical circuit interrupt devices. However, such devices conventionally provide for on-off control only, meaning that the device completely interrupts the flow of electrical power to the appliance while in the interrupt or "locked" state, and it connects the appliance to the electrical supply in the operative or "unlocked" state. In the case of, for example, a stove, once the supply power has been cut off auxiliary electrical equipment such as lighting and an electrical clock also ceases to function.

SUMMARY OF THE INVENTION

The present invention provides a security power interrupt for an electrical appliance whereby the appliance retains a connection to the power supply while in interrupt or "locked" mode; complete power shutoff only occurs when a preset electrical current is exceeded, thus allowing operation of the appliance's auxiliary electrical equipment while the device is in the interrupt mode.

In a preferred embodiment, the security power interrupt device of the present invention is controlled by a detachable electronic key pad, whereby a predetermined sequence of key strokes interrupts or restores power to the appliance. Power is supplied to the key pad by a DC current transformer from the wall outlet into which the device is plugged, and the appliance is in turn plugged into the main body of the device. Also in the preferred embodiment, the key pad is connected by a wire remotely from the main body of the device, allowing flexibility in the placement of the key pad. For this purpose the key pad may be provided with a magnet, for detachably affixing the key pad to the metallic housing of the appliance, or other affixing means.

Further, the key pad is detachable from the device, and when detached prevents the interrupt device from being switched out of the interrupt mode, thereby preventing attempts to break the coded key sequence and restore normal supply power to the appliance. The device automatically switches to the interrupt mode when the correct numerical sequence is entered on the key pad, after a preset time interval has passed since the last authorized use of the appliance or when the key pad is disconnected from the device. The feature whereby the interrupt automatically switches to the interrupt mode when the key pad is detached can also be applied to any other type of power interrupt device.

The present invention thus provides a device for interrupting power to an electrical appliance, comprising means for connecting the device to an electrical power supply, means for supplying electrical power to the appliance, means for switching the device between a mode in which power is supplied to the appliance and a mode in which power to the appliance is substantially interrupted, manually operable enabling means detachably coupled to the device for activating the means for switching the device, means for monitoring the enabling means to determine when the enabling means has been detached from the device, and means for interrupting power to the appliance responsive to detachment of the enabling means.

BRIEF DESCRIPTION OF THE DRAWINGS

In drawings that illustrate by way of example only a preferred embodiment of the invention.

FIG. 3*a* is a perspective view of the device of the present invention configured for a 120 V electrical appliance, showing the main body from the rear;

FIG. 3*b* is a perspective view of the main body of FIG. 3*a* from the front;

FIG. 4 is a perspective view of an alternate embodiment of the present invention having an extension cord;

DETAILED DESCRIPTION OF THE INVENTION

Figure 1:
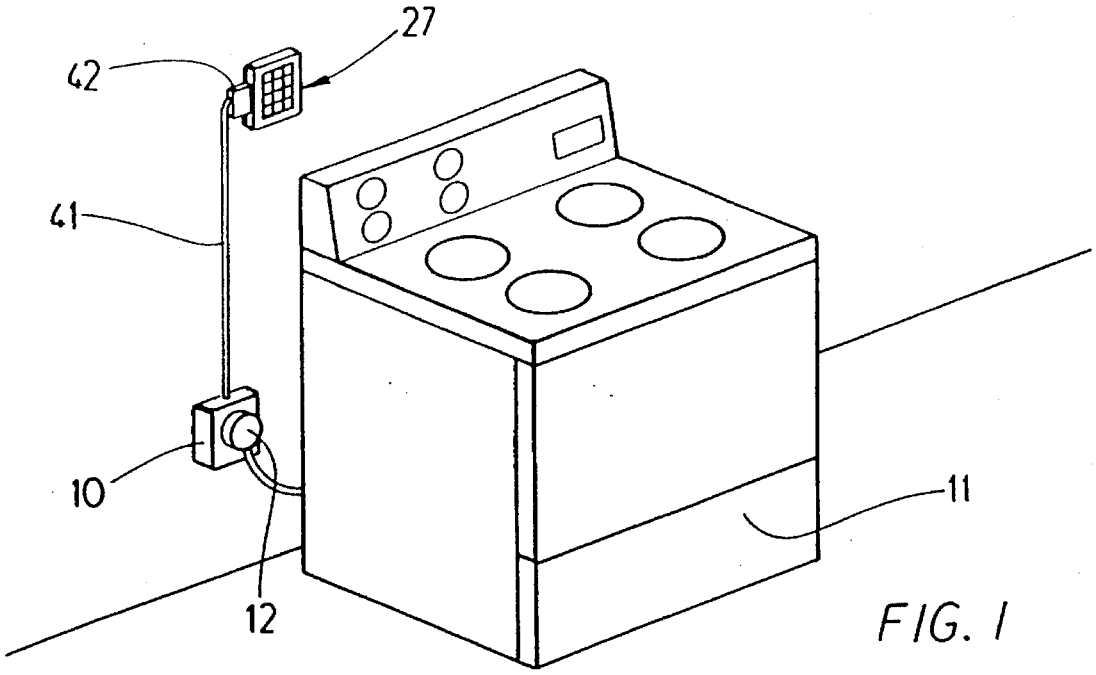
FIG. 1 is a schematic perspective view illustrating the invention connected to a 220 V electric stove, with the detachable key pad mounted on a wall.

The electrical plug 12 of an appliance 11, in the embodiment illustrated a stove operating on a 220 V household mains power supply, is connected to a female socket 19 in the main body 10 of the device for preventing unauthorized usage of an electrical appliance. The device is in turn plugged into a 220 V wall receptacle 14.

Figure 5:
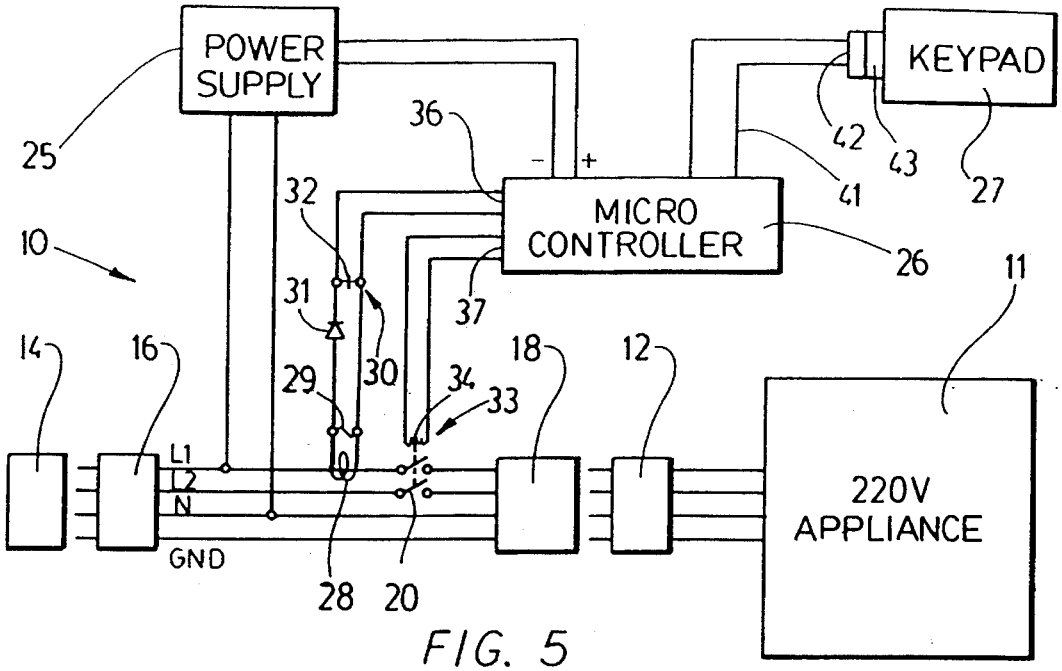
FIG. 5 is a schematic block diagram of the invention, configured to prevent unauthorized usage of a 220 V appliance, such as an electric stove.

The electrical circuitry, illustrated in FIG. 5 for a 220 V configuration of the device, is contained within the main body 10. The device interrupts the current from the power supply to the appliance 11 when the contacts 20 of the relay 33 are opened; the current from power supply is transferred to the appliance 11 when the contacts 20 of the relay 33 are closed.

Figure 6:
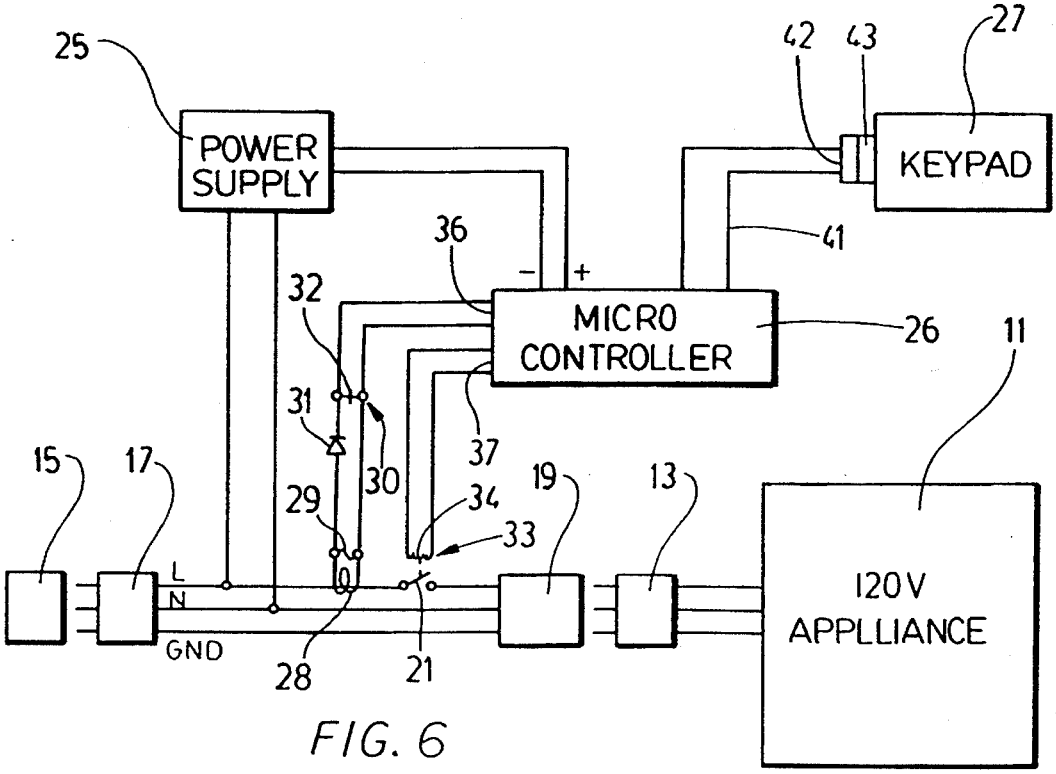
FIG. 6 is a schematic block diagram of the invention, configured to prevent unauthorized usage of a 120 V appliance, such as an electric range or space heater.

In the case of a 220 V appliance, relay contacts 20 are configured in dual-pole single-throw form, so that both voltage-carrying lines L1 and L2 are switched by the relay 33. In the case of a 120 V appliance, as shown in FIG. 6, the contacts 21 of the relay 33 are configured in single-pole single-throw form, so that the voltage-carrying line L is switched by the relay 33. In either configuration, the relay contacts, 20 or 21 must have the appropriate electrical rating for the appliance 11.

The device for preventing unauthorized usage of an electrical appliance in a preferred embodiment further comprises a DC power supply 25, which generates the direct current (DC) voltages required by the microcontroller 26; manually operable enabling means comprising a detachable key pad 27; a current transformer 28 with current transformer shunt 29; a rectifier circuit 30, conventionally comprised of rectifier diode 31 and filter capacitor 32; and means for switching the device between a mode in which power is supplied to the appliance and a mode in which power to the appliance is substantially interrupted comprising a relay 33 having relay coil 34 and contact sets 20 (for the 220 V embodiment of FIG. 5) or 21 (for the 120 V embodiment of FIG. 6).

FIG. 3 shows a preferred embodiment of the present invention for preventing unauthorized use of a 120 V appliance, such, as an electric heater or hot plate, by way of example. The main body 10 is in the form of a closed box, directly inserted between wall socket 15 and the appliance plug 13. Thus plug 17 is inserted in wall socket 15, with appliance plug 13 inserted into the socket 19 in the main body 10. Key pad cable 41, which implements the required electrical connections between the key pad 27 and the circuitry in the main body 10 of the device, has a cable connector 42, which can be connected to mating receptacle 43. Key pad 27 has a number of entry keys 44, as is conventional.

Figure 2:
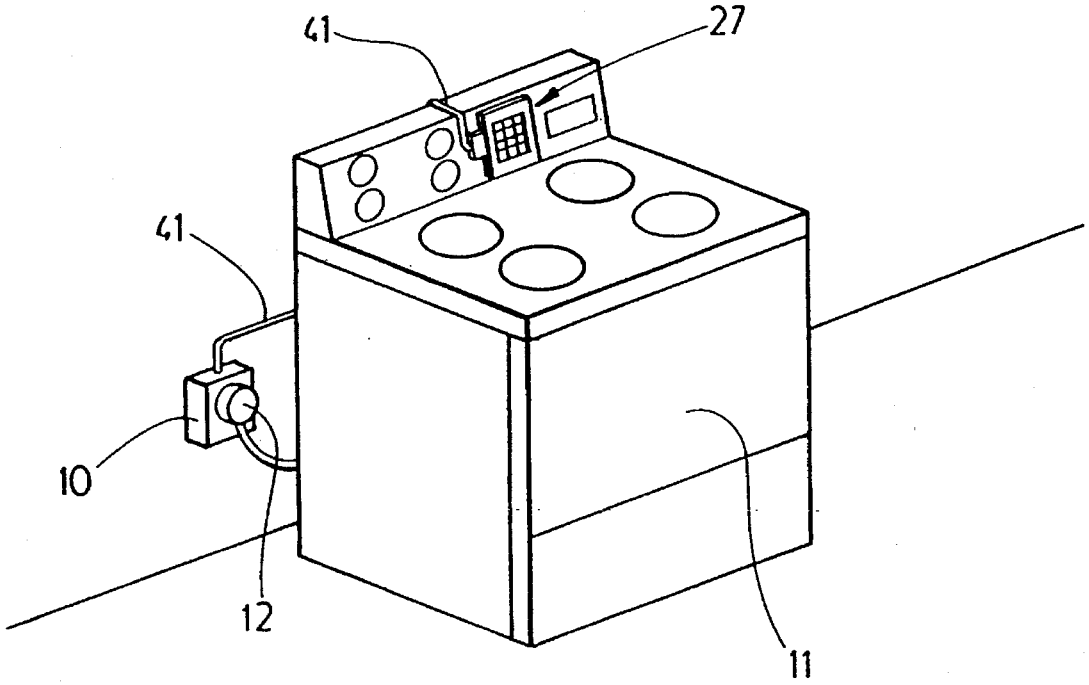
FIG. 2 is a schematic perspective view illustrating the embodiment of FIG. 1 connected to an electric stove, with the detachable key pad magnetically mounted on the stove.

For wallmount applications, as shown in FIG. 1, key pad 27 can be mounted to the wall with detachable adhesive material, such as "Velcro"(trademark), or with more permanent securing means. For appliance mounting applications, as illustrated in FIG. 2, key pad 27 is removably affixed to the metal body of the appliance 11 magnetically, by means of a magnet (not shown) mounted on the rear of the key pad 27.

Key pad 27 is also detachable from the device. The microcontroller 26 monitors the key pad 27 as described below, and when the key pad 27 is detached from the device automatically interrupts power to the appliance 11. This feature can be adapted for use with any power interrupt device provided with conventional logic for monitoring the enabling means and switching the power interrupt to the interrupt mode when the enabling means is detached.

FIG. 4 shows an alternate embodiment of the present invention, in which the male plug 17 is extended from the main body 10 by means of a power cord 45, similar to an electrical extension cord.

The embodiments of both FIGS. 3 and 4 are adapted for use with existing appliances, in that the appliance 11 itself does not require any alteration to utilize the device. In a further embodiment the invention may be integrated in the electrical wiring of the appliance 11 by the manufacturer, prior to sale of the appliance to the consumer.

The microcontroller 26 is of conventional design, having associated with it one analog input channel 36, on which it can acquire an analog input signal which is roughly proportional to the amount of electrical current drawn by the appliance 11; one digital output channel 37, through which the microcontroller 26 can control the flow of current from the mains power supply to the appliance 11 by energizing or de-energizing relay coil 34; and a key pad input for connection of detachable key pad 27.

Microcontroller 26 is electrically programmed with a software program performing the tasks which are necessary to implement the functions of the device. The software program is a conventional multi-tasking program, with each task implementing a distinct function. As a minimum, the software program performs the following tasks:

1) The first task is a key pad monitoring task for monitoring activity on the key pad 27. When a certain preset sequence of key strokes is received, referred to as the "locking sequence", this task sets the microcontroller to the interrupt or "locked" mode. When another preset sequence of key strokes is received, referred to as the "unlocking sequence", the key pad monitoring task sets the microcontroller to the operative or "unlocked" mode. The locking and unlocking sequences are only known to authorized persons. If an authorized person switches the device to the operative mode while the relay contacts 20 or 21 are in the open state due to a previous unauthorized attempt to use the appliance 11, the contacts 20 or 21 are closed by de-energizing relay 33 by eliminating the voltage from relay coil 34 through digital output line 37.

The key pad monitoring task supports additional key stroke sequences, in order to configure the microcontroller 26. This permits authorized persons to enter and alter the locking and unlocking sequences; to alter the current threshold at which power interrupt is engaged in the interrupt mode, to alter the "elapsed time threshold" which sets the time interval since the last authorized use following which the device will automatically enter the interrupt mode, and other system parameters as may be desired.

In addition, this task monitors whether the detachable key pad 27 is connected. When the key pad monitoring task determines that key pad 27 has been disconnected, the microcontroller 26 is automatically set to the interrupt mode. As noted above, this feature can also be applied to conventional power interrupt devices.

2) The second task is a current monitoring task which monitors the current drawn from the mains power supply by acquiring data on analog input channel 36. When this task determines that the current drawn from the mains power exceeds a preset limit, referred to as the "current threshold", if this occurs while the microcontroller is in the interrupt mode the current monitoring task will energize relay 33 by applying a voltage to the relay coil 34 through digital output line 37, thus opening relay contacts 20 or 21 and preventing transfer of supply power to the appliance 11. As noted above, when the microcontroller 26 is switched into the operative mode, this task de-energizes the relay 33 by eliminating the voltage from the relay coil 34 through digital output line 37. If the microcontroller 26 is in the operative mode, the current monitoring task monitors the electrical current drawn from the mains power supply while the microcontroller 26 remains in the operative mode, in order to determine when to notify the timing task (described below) that the electrical current has been reduced to below the current threshold, and when to notify timing task that the electrical current has exceeded the current threshold.

3) The third task is a timing task. When the microcontroller 26 is in operative mode, and the current monitoring task described above notifies the microcontroller 26 that the electrical current drawn from the mains power supply has just been reduced to below the current threshold, the timing task starts to count elapsed time. Similarly, when the microcontroller 26 is in the operative mode, and the timing task is in the process of counting elapsed time, and the current monitoring task notifies timing task that the current is once more exceeding the current threshold, then the timing task will stop counting elapsed time. When the microcontroller 26 is in the operative mode, and the elapsed time counted by the timing task reaches the "elapsed time threshold" referred to above, the microcontroller 26 will change to the interrupt mode. In addition, when the microcontroller 26 is in operative mode, the timing task implements a timer mode in which the length of time that current can be drawn in excess of the current threshold is limited to a preset time. After this preset time has elapsed, the timing task returns the microcontroller 26 to the interrupt mode, which will immediately cause the current monitoring task to interrupt the mains power supply as described above.

The operation of the device is as follows. To use the appliance 11 an authorized person first attaches the key pad 27 if necessary, then enters the unlocking sequence into the key pad 27. The device is thus switched to the operative mode, and the appliance 11 is fully operational. When the authorized person has finished with the appliance 11, the device is switched to the interrupt mode in one of three ways: 1) the authorized person enters the locking sequence into the key pad 27; 2) the authorized person detaches the key pad 27 from the cord 41 by disconnecting plug 42 from the receptacle 43 in the key pad 27; or 3) the authorized person takes no action, in which case the timing task's timer will count time until it reaches the "elapsed time threshold".

When the appliance 11 is in the interrupt mode, auxiliary functions, such as a clock and/or light, remain operational, so long as their combined current draw is less than the "current threshold". When an unauthorized person attempts to use the heating functions of the appliance 11, which draw a comparatively greater current, the current threshold will be exceeded and the relay contacts 20 or 21 will be opened, disconnecting the mains power supply from the appliance while still supplying power to the microcontroller 26 through DC power supply 25.

It will be understood that the device in the interrupt mode does not actually cut off power to the appliance, i.e. interrupt the mains power supply, until the current threshold is exceeded by turning on a high current-drawing component of the appliance 11, such as a heating element.

Thus unauthorized attempts to use the appliance are immediately obvious from the fact that the auxiliary clock and light functions no longer operate. After an unauthorized use, an authorized person must connect the key pad 27, if it has been disconnected, and enter the unlocking sequence to once more supply mains power to the appliance to energize the auxiliary functions.

In addition, if the authorized user leaves the high current-drawing functions (for example, a heating element in a stove) on beyond a preset time, all electrical functions of the appliance 11, including auxiliary equipment, will automatically be deactivated after the preset time has elapsed unless the authorized user re-enters the unlocking sequence on the key pad 27 to restart the time elapsed timer. This feature will be of considerable comfort to persons who, after having left the premises, worry about whether or not they in fact turned the appliance off.

In a further embodiment of the invention, in addition to the timing function the device is provided with sound-sensing means responsive to an audible signal emitted from a smoke detector in the vicinity of the device. In the event that the smoke detector is triggered, the audible alarm immediately triggers the device to deactivate the appliance.

In a still further embodiment the device is provided, preferably integral with or adjacent to the key pad 27, with a photosensor adjusted to be triggered by an open flame in the vicinity of the device. In this situation, if an open flame develops during use of an appliance such as a stove, the device automatically cuts power to the appliance.

In a still further embodiment of the invention the device is provided with a motion detector. The timing task of the microcontroller 26 is initiated when the motion detector fails to detect any motion in the vicinity of the appliance, and is reset when the motion detector detects motion in the vicinity of the appliance 11. In this fashion, the timing task would count elapsed time commencing from the last moment that a user was near the appliance 11. If the user returns to the appliance before the preset elapsed time threshold, the microcontroller 26 will stop counting elapsed time and reset the timing task. If the user does not return to the appliance before the elapsed time threshold has been reached, the appliance 11 is automatically deactivated as set out above. If desired, an audible alarm can sound at intervals while the microcontroller 26 is counting elapsed time, to remind the user that the appliance 11 is on. The timing task would also be reset to zero when the appliance 11 is manually turned off by the user.

In a still further embodiment of the invention the key pad 27 can comprise a conventional remote control device, the receiver for which is mounted on or near the appliance as described above, with detachable adhesive material or permanent securing means. In this embodiment, if a fire develops during operation of an appliance such as a stove, the user can deactivate the appliance from a safe distance, without the need to approach the appliance and risk injury.

The invention having been thus described with reference to preferred embodiments only, it will be appreciated by those skilled in the art that certain modifications and adaptations may be made without departing from the scope of the invention, as set out in the appended claims.

We claim:

1. A device for interrupting power to an electrical appliance, comprising means for connecting the device to an electrical power supply, means for supplying electrical power to the appliance, means for switching the device between a mode in which power is supplied to the appliance and a mode in which power to the appliance is substantially interrupted, manually operable enabling means detachably coupled to the device for activating the means for switching the device, means for monitoring the enabling means to determine when the enabling means has been detached from the device, and means for interrupting power to the appliance responsive to detachment of the enabling means.

2. The device of claim 1 in which the enabling means is a locking switch.

3. The device of claim 1 in which the means for monitoring the enabling means comprises a microcontroller.

4. The device of claim 1 in which the means for switching the device comprises a relay.

5. The device of claim 1 wherein in one mode in which power to the appliance is substantially interrupted the device supplies a leakage current to the appliance sufficient to energize one or more low current loads and in another mode in which power to the appliance is substantially interrupted the device completely shuts off power to the appliance.

6. The device of claim 1 including sound-sensing means responsive to an audible alarm from a smoke detector in the vicinity of the appliance, wherein power to the appliance is interrupted if the sound sensing means detects the sound of the alarm.

7. The device of claim 1 including a photosensor adjusted to be triggered by an open flame in the vicinity of the device, wherein power to the appliance is interrupted if the photosensor detects an open flame.

8. The device of claim 1 including a motion detector triggered motion in the vicinity of the device, wherein power to the appliance is interrupted if the motion detector does not detect motion in the vicinity of the device for a preset period of time.

9. The device of claim 1 wherein the enabling means comprises a remotely controlled receiver.

* * * * *